US006284056B1

(12) United States Patent
Gonzalez

(10) Patent No.: US 6,284,056 B1
(45) Date of Patent: Sep. 4, 2001

(54) SMOKER'S PIPE CLEANER AND METHOD OF USE

(76) Inventor: Gustavo M. Gonzalez, P.O. Box 142465, Gainesville, FL (US) 32614

( * ) Notice: Subject to any disclaimer, the term of this patent is extended or adjusted under 35 U.S.C. 154(b) by 0 days.

(21) Appl. No.: 09/372,198

(22) Filed: Aug. 11, 1999

Related U.S. Application Data

(60) Provisional application No. 60/096,091, filed on Aug. 11, 1998.

(51) Int. Cl.[7] ..... B08B 3/08; B08B 9/027; C11D 7/10; C11D 7/26

(52) U.S. Cl. ..... 134/40; 134/39; 134/42; 510/109; 510/365; 510/366; 510/397; 510/419; 510/197; 510/201; 510/238; 510/239; 510/240; 510/245; 510/253; 510/269; 510/271

(58) Field of Search ..... 510/109, 365, 510/366, 397, 419, 197, 201, 238, 239, 240, 245, 253, 269, 271; 134/42, 39, 40

(56) References Cited

U.S. PATENT DOCUMENTS 4,496,667 * 1/1985 Reichgott et al. ..... 521/26
4,877,459 * 10/1989 Cockrell, Jr. et al. ..... 134/40
5,858,106 * 1/1999 Ohmi et al. ..... 134/1

* cited by examiner

*Primary Examiner*—Mark Kopec
*Assistant Examiner*—Brian P. Mruk
(74) *Attorney, Agent, or Firm*—Pendorf & Cutliff

(57) ABSTRACT

A composition useful for removal of organic deposits from a ceramic, glass, plastic, or metal substrate, and a method of use thereof. In a preferred embodiment, the invention pertains to a composition for cleaning an organically fouled smoking apparatus such as a pipe, a cigarette holder, or a water pipe, and to a process whereby the smoking apparatus is cleaned and disinfected.

5 Claims, 1 Drawing Sheet

| | FORMULA 420 | PURPLE POWER** | GRUNGE OFF | DR. GREENS |
|---|---|---|---|---|
| SOAKING TIME (IN MINUTES) | 0 | 3 | 10 | 5 |
| SCRUBBING TIME (IN MINUTES) | 1 | 45 | 55 | 60 |

**throughout testing, 25% of the time Purple Power did require a few minutes of brushing, though they claim it is not necessary.

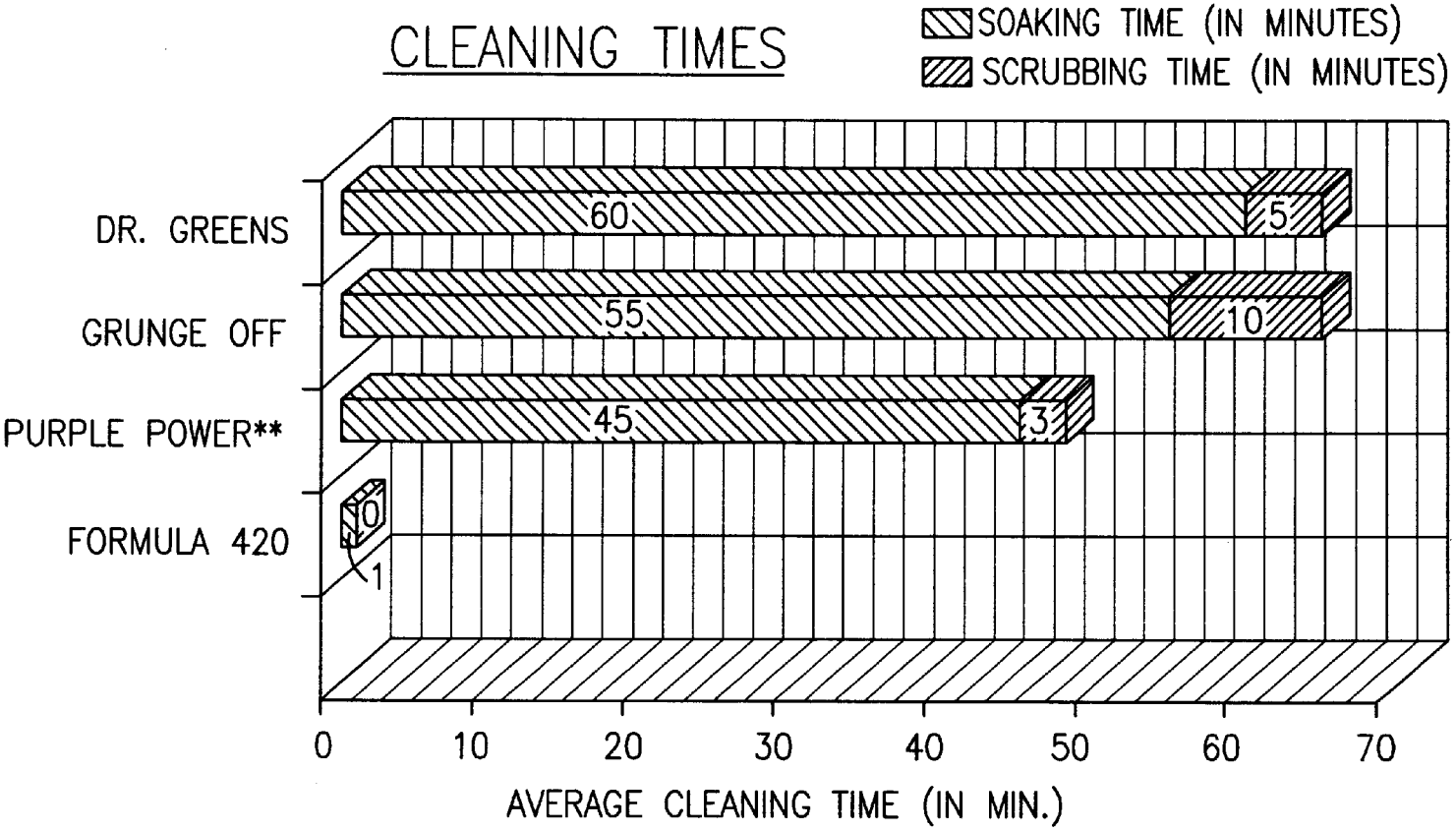
| | FORMULA 420 | PURPLE POWER** | GRUNGE OFF | DR. GREENS |
|---|---|---|---|---|
| SOAKING TIME (IN MINUTES) | 0 | 3 | 10 | 5 |
| SCRUBBING TIME (IN MINUTES) | 1 | 45 | 55 | 60 |
**throughout testing, 25% of the time Purple Power did require a few minutes of brushing, though they claim it is not necessary.

SMOKER'S PIPE CLEANER AND METHOD OF USE

CROSS REFERENCE TO RELATED APPLICATIONS

This application discloses and claims subject matter disclosed in provisional application Ser. No. 60/096,091, filed Aug. 11, 1998. The entire disclosure of the previous application is incorporated herein by reference

BACKGROUND OF THE INVENTION

1. Field of the Invention

The present invention relates to a composition useful for removal of organic deposits from a ceramic, glass, plastic, or metal substrate, and to a method of use thereof. In a preferred embodiment, the invention pertains to a composition for cleaning an organically fouled smoking apparatus such as a pipe, a cigarette holder, or a water pipe, and to a process whereby the smoking apparatus is cleaned and disinfected.

2. Description of the Related Art

The use of a pipe cleaner is known in the prior art. More specifically, pipe cleaners heretofore devised and utilized for the purpose of removing carbon residue and other organic scale for tobacco smoke are known to consist basically of familiar, expected, and obvious structural configurations, notwithstanding the myriad of designs encompassed by the crowded prior art which has been developed for the fulfillment of countless objectives and requirements.

Smoking devices generally comprise a receptacle for the tobacco, a mouthpiece, and a stem connecting the receptacle to the mouth piece. The stem assembly may be a simple longitudinal stem or a more complex shape such as a spiral. All types of smoking apparatus, whether they are ceramic, glass, plastic or metal, collect organic residue such as tar and scale on these internal surfaces over time. The scale accumulates in the stem and mouthpiece and eventually blocks the flow of smoke between the receptacle and mouthpiece. If not cleaned on a regular basis the pipe begins to draw poorly and eventually becomes clogged and unusable. Pipe replacement can become costly and expensive, thus pipe cleaning is considered routine maintenance for preserving a pipe in good working order.

Currently, smokers have two main methods of cleaning their smoking devices—dry and wet. Dry cleaning involves the well-known "pipe cleaner". This method is not suitable where the stem is long or convoluted. Wet cleaning may be active—involving a brush and a cleaning solution, or it may be passive—wherein the smoking device is allowed to soak in a cleaning solution.

By way of Example, the prior art includes U.S. Pat. No. 5,209,248 to Slade, Sr., disclosing a smoker's pipe filling and cleaning system. The cleaning system includes a battery operated, motor driven brush centrally mounted within an ash receptacle section. A pressure switch activates a motor causing the brush to rotate. The pipe bowl is simply inverted over the brush and pressed downward. The rotating brush removes debris from the pipe without scarring the pipe, the debris falling into and being captured in a heat resistant receptacle section surrounding the brush. This system is most useful for removing tobacco from the bowl of a pipe. This system does not address cleaning of he stem nor the mouth piece. Thus the problem of blockage would still exist.

U.S. Pat. No. 4,188,959 to Karalius discloses a brush-like device as a pipe cleaner having a first end, a second end and a handle section located between the first and second end. The pipe cleaner apparatus is constructed of bendable steel which allows it to assume various configurations for cleaning the bowl and the stem.

U.S. Pat. No. 2,306,622 to Gordon discloses an electronic motor driven pipe cleaner comprised of a thin disc-like brush or buffer wheel mounted transversely to the rotary axis of a small electric motor. The wheel is spun within the bowl of the pipe for cleaning. Again, this pipe cleaner only cleans the tobacco receptacle.

In view of the difficulty of mechanical type cleaners discussed above to access or adequately clean internal surfaces of a smoking apparatus, such as the internal surface of the mouthpiece or stem, there has been a recent trend to employment of liquid cleansers. Some liquid cleansers have been especially developed to break down and remove residue or scale in the stem and mouthpiece of the pipe. However, even these liquid cleansers merely provide a pre-soaking treatment and require brushing to remove deposits. Thus, areas not reached by a brush are not cleaned. This problem becomes acute in the case of convoluted or sharp angled stems or other pieces.

Purple Power liquid pipe cleanser, available through the internet, has sodium hydroxide as a main active ingredient, and requires that the piece being cleaned be soaked for at least 30 minutes, more usually 45 to 60 minutes, in a solution of Purple Power and water. Grunge Off® powder, also available through the internet, comes in the form of a concentrated powder. The powder is dissolved in hot water for about 45 minutes, and a pipe is soaked in the resulting solution and then scrubbed with a brush to remove scale. Another such liquid cleanser is Dr. Greens chalice cleanser, also available through the internet. This cleanser also requires mixing with hot water, soaking and brushing of the pipe. Each of these product requires soaking for at least about one-half hour and constant scrubbing for satisfactory scale removal, which is particularly difficult to achieve in hard-to- reach places.

The present inventor became familiar with the various commercially available liquid pipe cleansers, and felt that the long period of soaking was a significant inconvenience. Determined to find a better liquid pipe cleanser, the inventor began experimenting with various household detergent products, such as glass cleaners, tile cleaners, carpet cleaners, etc. He quickly realized that most of these products could be eliminated from consideration due to the unpleasant and possibly toxic residues left behind after cleaning.

For example, U.S. Pat. No. 5,858,106 to Ohmi et al. teaches a cleaning liquid comprised of pure water, isopropyl alcohol, and hydrofluoric acid, ammonium fluoride, or potassium fluoride. The cleaner is used to peel organic films such as photoresists off of a semiconductor. The cleaning liquid is used together with ultrasound. This cleaner would be potentially toxic, and would be difficult for the average consumer to use.

U.S. Pat. No. 5,522,580 to Varner, Jr. et al. teaches a method for removing stains from carpets, upholstery and other bulky items. The cleaner consist of an aqueous composition of hydrogen peroxide, isopropyl alcohol and deionized water. Experimentation has shown that hydrogen peroxide will not remove the scale.

Another cleaner is disclosed in U.S. Pat. No. 5,041,235 to Kilbarger. This patent discloses a liquid hard surface cleaner for porous surfaces. The composition contains a surfactant, a synthetic hydrocarbon oil and an aliphatic alcohol. This composition, if used for cleaning a pipe, would leave a residue on the internal surfaces of the pipe which could produce harmful fumes during subsequent smoking use.

Finally, U.S. Pat. No. 4,496,667 to Reichgott et al. discloses cleaning organically fouled anion exchange resins by first pre-soaking the resins in a brine-caustic solution for one hour, rinsing with distilled water, soaking in a brine-caustic 30% isopropanol solution for one hour, rinsing, and repeating the second soaking step. The use of a one to four carbon monohydric alcohol in the second soaking step was found to provide a 100% improvement in resin removal. This process is both time-consuming (taking at least three hours) and complex, and thus does not provide a solution to the problem addressed by the inventor.

Therefore, it can be appreciated that there exists a need for a new and improved method for cleaning and disinfecting a smoker's pipe capable of removing organic scaling on the smoking apparatus quickly and in a single cleaning cycle.

SUMMARY OF THE INVENTION

It is therefore an object of the present invention to provide a new and improved smoker's pipe cleaner which represents a vast improvement over the above-discussed pipe cleaners.

It is another object of the present invention to provide a new and improved smoker's pipe cleanser and method of using same.

It is further object of the present invention to provide a new and improved smoker's pipe cleanser and method of using same which is a durable and stable composition, and formulated of ingredients which are natural and non-toxic in the intended environment of use.

Still yet another object of the present invention is to provide a new and improved liquid smoker's pipe cleanser which achieves a cleaning and disinfecting in a much shorter time 20 to 60 seconds, and without scrubbing, as compared to conventional liquid pipe cleansers requiring 30 to 60 minutes of soaking followed by scrubbing.

These and other objects have been accomplished by the development of a cleansing composition which comprises, as main active ingredients, (a) an organic solvent, preferably a one to five carbon alcohol, most preferably isopropyl alcohol, (b) an inorganic salt in crystalline form, preferably a sodium halide, which from a cost perspective is most preferably sodium chloride, and (c) water. The alcohol:water ratio in the final composition is preferably in the range of from 9:1 to 2:1, preferably 8:1 to 5:1.

Surprisingly, superior cleaning can be achieved in a very short period of time (about 20 seconds), and without scrubbing, due to the interaction of the alcohol, the briny salt/water combination, and the crystalline salt. The crystalline salt imparts a mechanical cleaning effect and supplements the chemical effects of the alcohol and brine. The combination of the alcohol, brine and crystalline salt produces an unexpectedly rapid and superior de-scaling and disinfecting of the internal surfaces of a smoking device, and can produce excellent results in as little as 20 seconds, and usually in less than one minute. This represents a significant improvement over the prior art cleansing solutions, which required a minimum of one-half hour to soak, and which are not designed to disinfect. The prior art cleansing solutions are thus not only comparatively ineffective in cleaning and santitization ability, but they are annoying to use, and further require large quantities in order to immerse the device being cleaned, and thus are associated with significant cost.

Further, in accordance with the present invention it is only necessary to expose the internal surfaces of the smoking device to the cleansing composition. This represents a significant saving over cleansing compositions which instruct the user to immerse the entire smoking device in the cleansing solution.

It has been found to be an advantageous property of the composition of the present invention that the salt, which serves as a mechanical abrasive, does not clog the interior surfaces of the smoking device, this being due to the water solubility of the salt resulting in the complete removal of any residual salt during the final step of rinsing the smoking device after cleaning. Any other solid abrasives, in comparison, would stick to the organic deposits in the interior surfaces of the smoking device and clog even zigzagged internal passages.

It has also been surprisingly found that the composition of the present invention has a very high disinfecting property, this believed to be attributable to the high concentration of alcohol.

Further yet, the simplicity, speed, and effectiveness of the present cleansing composition causes smokers to clean their smoking devices more frequently, resulting in more pleasant and healthier smoking experience.

In a preferred embodiment, the cleansing composition preferably comprises about 25 to 55 wt. % alcohol and about 20 to 49 wt. % of crystalline salt. The composition further includes from about 0.01 to 07 wt. % fragrance, from about 0.01 to 0.07 wt. % dye, and distilled water as the balance of the composition, preferably in an amount of 10 to 50 wt. % of the total composition.

Where desired, surfactants may be added in amounts of from 0.5 to 3 wt. %, a preferred surfactant being octoxynol-9.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of use and to the components being acted upon set forth in the following description. The invention is capable of acting upon other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the formulation of other compounds, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the descriptive matter in which there is illustrated preferred combination of ingredients of the invention.

BRIEF DESCRIPTION OF THE DRAWING

The invention will be better understood and objects other than those set forth above will become apparent when consideration is given to the following detailed description thereof. Such description makes reference to the annexed drawing wherein:

FIG. 1 is a graphic illustration of the cleaning time variance between the present cleanser and commercially available cleansers.

DETAILED DESCRIPTION OF THE INVENTION

The cleansing composition of the present invention comprises, as main active ingredients, an organic solvent, preferably a one to five carbon alcohol, most preferably isopropyl alcohol, and an inorganic salt in crystalline form, preferably a sodium halide, which from a cost perspective is most preferably sodium chloride. Salt has a high solubility in water, and a low solubility in alcohol. For example, the solubility of sodium chloride in ethyl alcohol at room temperature (25° C.) is only 0.065 g/100 g alcohol. The solubility in methyl alcohol is 1.4 g/100 g alcohol.

Due to the high solubility of salt in water (and poor solubility in alcohol), as the proportion of alcohol is increased, the lower the amount of salt needed to ensure presence of crystalline salt in the final composition. As the proportion of water is increased (and the proportion of alcohol is correspondingly decreased), the proportion of salt must also be increased in order to ensure the presence of inorganic salt in crystalline form in the final composition.

Due to the presence of undissolved salts in the composition of the present invention, the composition is referred to as a composition and not as a solution.

The proportion of water which may be present in the final composition and be within the scope of the invention can be functionally determined. If insufficient water is present, there is an insufficient formation of brine and the effectiveness of the cleansing composition is reduced. As the proportion of water is increased, the water content will eventually reach a point at which the solubility for salt is too great, excessive amounts of salt will dissolve, and crystals will not be present in the cleansing composition. Accordingly, the alcohol:water ratio in the final composition is preferably in the range of from 9:1 to 2:1, preferably 8:1 to 5:1.

Surprisingly, superior cleaning can be achieved in a very short period of time (20–60 seconds) due to the interaction of the alcohol, the briny salt/water combination, and the crystalline salt. The crystalline salt imparts a mechanical cleaning effect and supplements the chemical effects of the alcohol and brine. The combination of the alcohol, brine and crystalline salt produces an unexpectedly rapid and superior de-scaling and disinfecting of the internal surfaces of a smoking device, and can produce excellent results in as little as 20–60 seconds without brushing. This represents a significant improvement over the prior art cleansing solutions, which required a minimum of one-half hour of soaking, followed by scrubbing, and which are not designed to disinfect.

Further, in accordance with the present invention it is only necessary to expose the internal surfaces of the smoking device to the cleansing composition. This represents a significant saving over cleansing compositions which instruct the user to immerse the entire smoking device in the cleansing solution.

In a preferred embodiment, the cleansing composition preferably comprises about 25 to 55 wt. % alcohol and about 20 to 49 wt. % of crystalline salt. The composition further includes from about 0.01 to 07 wt. % fragrance, from about 0.01 to 0.07 wt. % dye, and distilled water as the balance of the composition, preferably in an amount of 10 to 50 wt.W of the total composition.

Where desired, surfactants may be added in amounts of from 0.5 to 3 wt. %, including surfactants having the formula alpha-4-(1,1,3,3-tetramethylbutyl)phenyl-omega-hydroxypoly(oxy-1,2-ethanediyl) (Octoxynols), most preferably octoxynol-9. Such preferred surfactants include the TRITON.RTM. X series, such as TRITON.RTM. X-100 and TRITON.RTM.X-305, available from Rohm & Haas Co., Philadelphia, Pa., and the Igepal CA series from GAF Corp., New York, N.Y.

Preferred formulations of the cleanser composition will be described below in the context of a smoker's pipe cleanser embodying the principles and concepts of the present invention.

The present invention, the smoker's pipe cleanser is comprised of a mixture of specific ingredients. Such ingredients in their broadest context include an organic solvent, preferably an alcohol; fine granules of a solid material, preferably a salt which is at least partially in crystalline form; water, dye and fragrance. This unique combination of ingredients possesses unexpectedly superior organic residue removal and sterilization properties as compared to properties possessed by the several ingredients individually.

Specifically, the present invention provides a pipe cleansing composition comprising a mixture of an organic solvent, an inorganic salt and water. Fragrance and color are inert with respect to cleaning formulation, and are added to the composition to create a recognizable appearance and smell, and to make the composition more appealing to the consuming public.

The applicant has found that pipes are quick and easily cleaned and made free of organic residue and scale when these pipe foulants are acted on with a composition consisting of an alcohol, a solid salt and water.

Exemplary organic solvents which can be used in the present invention have the following physical-chemical characteristics:

| | | |
|---|---|---|
| Ethanol | $CH_3CH_2OH$ | mwt. 46.0 |
| Methanol | $CH_3OH$ | mwt. 32.03 |
| Isopropanol | $CH_3CHOHCH_3$ | mwt. 60.09 |

Exemplary inorganic salts which can be used in the present invention have the following physical-chemical characteristics:

| | | | | |
|---|---|---|---|---|
| Sodium Chloride | NaCl | mwt. | 58.4428 | sp.gr. 2.165 |
| Sodium Bromide | NaBr | mwt. | 102.90 | sp.gr. 3.203 |
| Magnesium Bromide | $MgBr_2$ | mwt. | 184.13 | sp.gr. 3.72 |
| Magnesium Chloride | $MgCl_2$ | mwt. | 95.22 | sp.gr. 2.316 |
| Potassium Chloride | KCL | mwt. | 74.54 | sp.gr. 1.984 |
| Potassium Bromide | $KBr_2$ | mwt. | 119.01 | sp.gr. 2.75 |
| Zinc Chloride | $ZnCl_2$ | mwt. | 136.30 | sp.gr. 2.91 |

The cleansing composition of the present invention in one form has from 25 to 55 wt. % organic solvent based on the total composition, from 20 to about 49 wt. % of inorganic salt, at least some of which is in a solid (crystalline) form, from about 0.01 to 2 wt. % of the composition of a fragrance, from about 0.01 to 2 wt. % of the composition of a dye, and from about 10 to 20 wt. % of the composition of distilled water.

The present invention in another form has an organic solvent comprising from 20 to about 30 wt. % of the total composition, an inorganic salt comprising from 20 to about 49 wt. % of the composition, octoxynol-9 comprising from to about 0.5 to 3 wt. % of the composition, a fragrance comprising from about 0.01 to 2 wt. % of the composition, a dye comprising from about 0.01 to 2 wt. % of the composition, and distilled water comprising from about 40 to 70 wt. % of the composition.

The present invention will be better understood from the examples which follow. The below examples are illustrative of the preferred organic solvent and inorganic salt, and are intended to be illustrative only and not meant to unduly limit the scope of the invention. Unless otherwise indicated, percentages are on a percentage of composition basis.

EXAMPLE I

A smoker's pipe cleanser was prepared having the following formulation.

| Component | wt. % |
|---|---|
| Isopropyl Alcohol | 47 |
| Sodium Chloride | 37 |
| Deionized water | 13 |
| Fragrance | 1.5 |
| Dye | 1.5 |
| Total | 100 |

The composition was prepared by combining the organic solvent, the water, the fragrance and dye with stirring until well blended. Then the finely divided salt crystals were slowly added, and again stirred to allow a small amount of the salt to dissolve into the solution. After preparation the composition remained stable.

The composition was shaken then poured into the stem of a glass pipe, the ends of the pipe were sealed by finger pressure, and the pipe was vigorously agitated for about one minute. Shaking the composition allowed the organic salt to be evenly disbursed within the solution. The organic residue and scale deposited along the interior of the pipe was removed without damage to the pipe during each test. The identical composition was poured into an acrylic pipe, the ends were sealed by finger pressure, and the pipe was vigorously agitated for about one minute. In testing the composition with acrylic pipes it was noted that cracking occurred in the pipe about 40k of the time. The composition was tested on ceramic and metal pipes with no harm to the pipes.

EXAMPLE II

A smoker's pipe cleanser was prepared having the following formulation.

| Component | % wt. |
|---|---|
| Isopropyl Alcohol | 37 |
| Sodium Chloride | 37 |
| Deionized water | 23 |
| Fragrance | 1.5 |
| Dye | 1.5 |
| Total | 100 |

The composition was prepared by combining the organic solvent, the water, the fragrance and dye with stirring until well blended. Then finely divided salt crystals were slowly added, and the mixture was again stirred to allow a small amount of the salt to dissolve into the solution. It was noted that the increased amount of water caused a greater amount of salt to dissolve, but some salt remained in crystalline form. After preparation the composition remained stable.

The composition was shaken then poured into the stem of a glass pipe, the ends of the stem were sealed with finger tip pressure, and the stem was vigorously agitated for about one minute. The organic deposit and scale along the interior of the pipe was removed without damage to the pipe during each test. The identical composition was poured into an acrylic pipe and the pipe was vigorously agitated for about one minute. It was noted that acrylic pipes cracked about 30% of the time.

EXAMPLE III

A smoker's pipe cleanser was prepared having the following formulation.

| Component | % wt. |
|---|---|
| Isopropyl Alcohol | 27 |
| Sodium Chloriae | 37 |
| Dionized water | 33 |
| Fragrance | 1.5 |
| Dye | 1.5 |
| Total | 100 |

The composition was prepared by combining the organic solvent, the water, the fragrance and dye with stirring until well blended. Then finely divided salt crystals were slowly added, and the mixture was stirred to allow a small amount of the salt to dissolve into the aqueous phase. After preparation the composition remained stable.

The composition was shaken then poured into the stem of a glass pipe, the ends of the stem were sealed with finger pressure, and the stem was vigorously agitated for about one minute. The organic deposit and scale along the interior of the pipe was removed without damage to the pipe during each test. The reduction in organic solvent reduced the amount of inorganic salt available as an abrasive in the composition. The identical composition was poured into an acrylic pipe and vigorously agitated for about one minute. In testing the composition with acrylic pipes it was noted that cracking occurred in the pipe 25% of the time.

EXAMPLE IV

A smoker's pipe cleanser was prepared having the following formulation.

| Component | % wt. |
|---|---|
| Isopropyl Alcohol | 25 |
| Sodium Chloride | 37 |
| Deionized water | 35 |
| Fragrance | 1.5 |
| Dye | 1.5 |
| | 100 |

The composition was prepared by combining the organic solvent, the water, the fragrance and dye with stirring until well blended. Then finely divided salt crystals were slowly added, and the mixture was again stirred to allow a small amount of the salt to dissolve into the aqueous phase. After preparation the composition remained stable.

The composition was shaken then poured into the stem of a glass pipe, the ends of the stem were sealed with finger pressure, and the stem was vigorously agitated for about one minute. The organic deposit and scale along the interior of the pipe was removed without damage to the glass pipe stem during each test. The identical composition was poured into an acrylic pipe and vigorously agitated for about one minute. In testing the composition with acrylic pipes it was noted that cracking occurred in the pipes about 22% of the time. Further, the cleaning action of the organic solvent was reduced.

The applicant continued testing to find a composition that completely eliminated cracking of the acrylic pipe.

EXAMPLE V

A smoker's pipe cleanser was prepared having the following formulation.

| Component | wt. % |
|---|---|
| Isopropyl Alcohol | 18 |
| Sodium Chloride | 37 |
| Deionized water | 39.5 |
| Octoxynol-9 | 2.5 |
| Fragrance | 1.5 |
| Dye | 1.5 |
| Total | 100 |

The composition was prepared by combining the organic solvent, Octoxynol-9, the water, the fragrance and dye with stirring until well blended. Then finely divided salt crystals were slowly added, and stirring was continued to allow a small amount of the salt to dissolve into the aqueous phase. After preparation the composition remained stable.

The composition was shaken then poured into the stem of a glass pipe, the ends of the stem were sealed with fingertip pressure, and the stem was vigorously agitated for about one minute. The organic residue along the interior of the pipe was removed without damage to the pipe during each test. The identical composition was poured into an acrylic pipe and vigorously agitated for about one minute. In testing the composition with acrylic pipes it was noted that cracking reduced now to where about 10% of the cleaned acrylic pipes cracked but the cleaning time had been slightly increased. In view of the increase in time needed to clean the pipe, it wad decided to conduct further experimentation to find a faster acting formulation.

EXAMPLE VI

A smoker's pipe cleanser was prepared having the following formulation.

| Component | wt. % |
|---|---|
| Isopropyl Alcohol | 17.6 |
| Sodium Chloride | 37 |
| Deionized water | 39.5 |
| Octoxynol-9 | 2.9 |
| Fragrance | 1.5 |
| Dye | 1.5 |
| Total | 100 |

The composition was prepared by combining the organic solvent, Octoxynol-9, the water, the fragrance and dye with stirring until well blended. Then the finely divided salt crystals were slowly added, and again stirring to allow a portion of the salt to dissolve into the aqueous phase. After preparation the composition remained stable.

The composition shaken then poured into the stem of a glass pipe and vigorously agitated for about one minute. The organic deposit and scale along the interior of the pipe was removed without damage to the pipe during each test. The same composition was poured into an acrylic pipe and the pipe was vigorously agitated for about one minute. It was noted that cracking was eliminated and the cleaning time of this composition was equivalent to the cleaning time in Example I. It appeared that the addition of octoxynol-9 supplemented the scale removal and cleaning action, and that the reduction in isopropyl alcohol concentration overcame the problem of cracking of acrylic pipes.

DISCUSSION

The results reported in Example 1 indicate that higher concentrations of the organic solvent work best in pipes made of glass, ceramic and metal. However it was noted that a high concentration of the organic solvent was harsh and harmful to pipes made of acrylic.

The results reported in Example VI indicate that reduced levels of the organic solvent in combination with the octoxynol-9 yield the same cleaning results of Example I, but without harm to acrylic.

The composition of the present invention thus facilitates the quick, efficient and simple cleaning of pipes—all without a brush —eliminating the conventional time-consuming process which consists of soaking for at least one half hour followed by scrubbing with a brush and which does not result in sterilization of the device. The inventive composition is simply poured into the pipe either through the bowl or the mouth piece. The composition is agitated within the pipe for about one minute. The action of agitating the composition within the pipe allows the composition to have complete contact with the entire interior surface of the pipe. The inorganic salt, undissolved in the organic solvent acts as an abrasive and scours the interior walls of the pipe stem, mouth piece and bowl. The action of the inorganic salt against the interior surface of the pipe facilitates removal of the accumulated scale and organic residue, which is softened by the organic solvent. Further, the organic solvent disinfects any potentially harmful germs and bacteria within the pipe. The final outcome is a clean pipe that had been disinfected and deodorized and, depending upon addition of fragrance, a pipe which is pleasantly scented.

The organic solvents and inorganic salts preferably used in the present invention are all natural and non-toxic. After cleaning the pipe the composition may be disposed of by pouring down a sink. The material is easily washed down the drain because the composition is highly soluble in water.

As to the manner of usage and operation of the present invention, the same should be apparent from the above description. Accordingly, no further discussion relating to the manner of usage and operation will be provided.

With respect to the above description then, it is to be realized that the optimum proportional relationships for the ingredients of the composition, to include variations amounts of components by weight of the entire composition and manner of intermixing are deemed readily apparent and obvious to one skilled in the art, and all equivalent relationships to those described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A cleanser composition consisting of:

from about 15 to 20 wt. % based on the total composition of a one to four carbon monohydric alcohol;

from about 0.05 to 3 wt. % based on the total composition of octoxynol-9;

from 20 to about 49 wt. % based on the total composition of an inorganic salt, at least a portion of which is in crystalline form; and water.

2. A cleanser composition consisting of:

from about 15 to 20 wt. % based on the total composition of a one to four carbon monohydric alcohol;

from about 0.05 to 3 wt. % based on the total composition of octoxynol-9;

from 20 to about 49 wt. % based on the total composition of an inorganic salt, at least a portion of which is in crystalline form;

from about 0.01 to 2.0 wt. % based on the total composition of a fragrance;

from about 0.01 to 2.0 wt. % based on the total composition of a dye; and from about 40 to 70 wt. % based on the total composition of water.

3. A method for removing organic deposit from a surface of a smoking device, the method comprising:

forming a cleanser composition by combining (a) a one to five carbon monohydric alcohol, (b) an inorganic salt, and (c) water, in such proportions that at least part of said inorganic salt remains in crystalline form;

exposing the smoking device to the composition under agitation for about twenty seconds to two minutes; and removing the composition and removing organic deposit from the smoking device.

4. A method as in claim 3, wherein said agitation is carried out for a period of from twenty seconds to one minute.

5. A method for removing organic deposit from a surface of a solid article, the method comprising:

forming a cleanser composition by combining (a) a one to five carbon monohydric alcohol, (b) an inorganic salt, and (c) water, in such proportions that at least part of said inorganic salt remains in crystalline form;

exposing the solid article to the composition under agitation for about twenty seconds to two minutes; and removing the composition and removed organic deposit from the solid article wherein said cleanser further includes octoxynol-9.

* * * * *